United States Patent [19]

Schürholz

[11] Patent Number: 4,819,372

[45] Date of Patent: Apr. 11, 1989

[54] SUPPORT FOR SECURING SLOPE COVERS AGAINST SLIPPAGE

[75] Inventor: Heinrich Schürholz, Dorsten, Fed. Rep. of Germany

[73] Assignee: DE-KO-WE Schürholz Teppichfabrik GmbH, Dorsten, Fed. Rep. of Germany

[21] Appl. No.: 212,103

[22] Filed: Jun. 21, 1988

Related U.S. Application Data

[63] Continuation of Ser. No. 852,310, Mar. 31, 1986, abandoned.

[30] Foreign Application Priority Data

Aug. 1, 1984 [DE] Fed. Rep. of Germany ... 8422934[U]

[51] Int. Cl.[4] ..... A01G 7/00; E02B 3/12

[52] U.S. Cl. ..... 47/9; 405/16

[58] Field of Search ..... 52/608; 405/15-20; 47/9, 25, 32, 33, 56, 47; 273/29 B, 30, 181 F, 29 A

[56] References Cited

U.S. PATENT DOCUMENTS

| | | | |
|---|---|---|---|
| 591,256 | 10/1897 | Hunley et al. | 405/15 |
| 1,905,176 | 4/1933 | Kieckhefer | 405/15 X |
| 2,143,461 | 1/1939 | Waring | 47/9 |
| 2,923,093 | 2/1960 | Allen | 47/56 |
| 3,001,795 | 9/1961 | Johnson | 273/181 F |
| 3,315,408 | 4/1967 | Fisher | 405/16 X |
| 3,945,406 | 3/1976 | Wueger | 139/54 |
| 4,258,523 | 3/1981 | Waugh | 47/47 |

FOREIGN PATENT DOCUMENTS

| | | | |
|---|---|---|---|
| 1151427 | 8/1983 | Canada . | |
| 1484570 | 5/1969 | Fed. Rep. of Germany | 405/19 |
| 1956411 | 9/1971 | Fed. Rep. of Germany | 405/16 |
| 2540887 | 3/1977 | Fed. Rep. of Germany | 47/9 |
| 1115084 | 4/1956 | France | 405/16 |
| 2367149 | 5/1978 | France | 405/15 |
| 136332 | 10/1980 | Japan | 405/16 |
| 16730 | 2/1981 | Japan | 405/15 |
| 39237 | 4/1981 | Japan | 405/15 |
| 39238 | 4/1981 | Japan | 405/15 |
| 51335 | 3/1982 | Japan | 405/15 |
| 201425 | 12/1982 | Japan | 405/15 |
| 30723 | 2/1985 | Japan | 405/16 |
| 168821 | 9/1985 | Japan | 405/16 |
| 208518 | 10/1985 | Japan | 405/17 |
| 638663 | 12/1978 | U.S.S.R. | 405/15 |
| 1506396 | 4/1978 | United Kingdom | 273/181 F |

*Primary Examiner*—Robert A. Hafer
*Assistant Examiner*—Danton D. DeMille
*Attorney, Agent, or Firm*—Ronald G. Goebel; William C. Long

[57] ABSTRACT

A support band (10) may be vertically mounted by piles (11) at the steep surface (3) of a bank before the latter is covered by filling materials (6) consisting substantially of soils appropriate to cultivation, in order to form a grid which covers the surface (3) of the bank. The support band is comprised of a cloth (20) of which the warp and weft yarns (21, 22 respectively) are made of a fibrous material of vegetable origin.

12 Claims, 2 Drawing Sheets

SUPPORT FOR SECURING SLOPE COVERS AGAINST SLIPPAGE

This application is a continuation of Ser. No. 852,310 filed Mar. 31, 1986 now abandoned.

"The invention relates to a support for securing covers of slopes to prevent slippage which is formed prior to the placement of slope covering material, particularly soil allowing the growth of vegetation, onto the slope surface by fixing support bands placed on edge through pegs to the slope surface so as to extend in a net-like or grid-like pattern over the slope surface".

It is known to cover natural or artificial slopes with a covering layer for securing them and for protection against erosion or for plant growth so that after a certain amount of plant growth has taken place there is also a securing and erosion protective effect. Slopes along motorways and other overland roads are for example provided with a cover for the growth of vegetation on a large scale.

The slope covers have to be secured to prevent slippage on the slope surface which is provided with the granular slope covering material, this also being necessary in the case of covers with plant growth at least until the plants, i. e. their roots have produced an internal consolidation of the slope cover as such and a connection between it and the surface of the slope which prevents any slippage of the slope covering earth, adapted for the growth of plants, on the slope surface. It is more especially in the case of prolonged and/or heavy rainfall that there will be a great danger of the slope covering material being washed away so that the slope cover will slide down the slope.

Support bands have in the past been developed for such securing of covers of slopes against slippage, the bands being made up of a plurality of mutually parallel separate bands of plastic or of such separate bands and a further single band coiled around them also made of plastic, such bands being anchored on edge on the slope to be secured with pegs, which are driven generally vertically into the surface of the slope in order to form a network covering the surface of the slope, whereafter a soil suitable for the growth of plants is dumped on the slope surface, spread out and leveled off so that the support band network is bedded in the cover of the slope so produced and supports the cover on the oblique slope surface (see German patent application No. 2,446,202, and German Utility Modle No. 7.529,025).

These known support bands of plastic are disadvantageous, more especially for environmental reasons, since they represent foreign bodies in the slope cover and do not rot, something moreover impeding any later removal, modification and renewal operations on the slope cover and the slope itself. Furthermore the separate ands are not permeable to air or water and do not absorb them. The putting in place of the support bands is still comparatively heavy on labor despite certain simplifications.

The same is true of later developed, known, slope cover securing systems using scrap vehicle tires or annular articles of rot-proof material, more especially plastic, which are embedded in the cover of the slope and which are placed on the slope surface prior to the dumping of slope covering material, more especially for the growth of plants thereon, and are fixed together and to the slope surface by means of anchors which are driven in (see German Utility Models Nos. 7,532,957 and 7,639,784).

Therefore on slopes, more particularly next to motorways and other overland roads, having an inclination of 1:1.5 and a height of 20 to 25 meters plaited brushwood barriers are still used in order to secure the cover of the slope. However brushwood is not sufficiently available at all times of the year and hard to store in sufficient quantities. Furthermore transport to the site of application is a somewhat complex operation, this also being true of the plaiting of the brushwood barriers, which needs much labor and skilled workers and is expensive, something that is also significant in the case of any later repairs.

As a rule the brushwood barriers are laid in the form of a net with square openings, whose two diagonals are parallel to the foot of the slope and the line of slope, respectively. The brushwood barriers are produced by driving in wooden pegs, generally with a length of about 30 centimeters, and with a certain spacing along the grid lines of the network, vertically into the slope surface to be covered and plaiting the brushwood around the pegs. Then the slope covering material in the form of suitable soil is dumped on the slope, spread out and leveled so that it fills up the net openings formed by the plaited brushwood barriers and reaches a height of about 20 centimeters as a slope cover, which is then planted with vegetation.

It is more especially the case with prolonged and/or heavy rainfall that neither such brushwood barriers, nor the support bands of plastic intended to replace the brushwood barriers, will provide a reliable safeguard against slippage of the slope cover. More especially such contrivances are not in a position always to prevent the wash out of slope cover material reliably.

The aim of the invention is to provide a support band for securing slope covering material against slippage, which is extremely simple and rapid to establish on slope surfaces and makes it extra ordinarily simple and rapid to undertake any repairs which may be necessary on the array of support bands securing the slope cover against slippage on the surface of the slope and has a comparatively high strength, a sufficient density for retaining the granular slope cover and an extremely even and constant power to let through and absorb and store air and water so that owing to such extraordinary capacity to take up and store water it acts against any excessively high uptake of water in the slope cover, which would favor the wash out of the same, even in the case of prolonged and/or heavy rainfall, and may be incorporated the slope cover without any undesired effects on the environment and furthermore is able to rot.

This object is attained by a support comprising a plurality of support bands fixed to a plurality of pegs driven into a slope surface to form a net covering the surface of the slope, the support bands comprising a fabric having warp and filler threads produced from a vegetable fiber material. Advantageous further developments of the support in accordance with the invention for securing slope covers against slippage are specified in the remaining claims.

In what follows an account will be given of one embodiment of the support of the invention for securing slope covers against slippage on the basis of diagrammatic drawings and by way of example.

Figure 1:
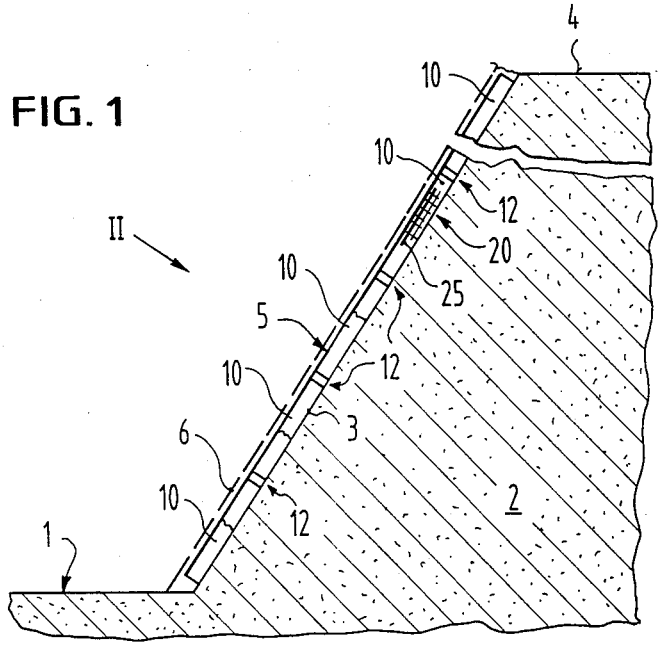
FIG. 1 is a cross section of a slope along a motorway with a slope cover, which is secured against slippage by means of a support in accordance with the invention on the surface of the slope.

As will be seen from FIG. 1 a slope extending along the track 1 of a motorway has an inclined surface 3. The slope 2 may have a height of 20 to 25 meters between the foot of the slope at the level of the track 1 and the top 4 of the slope. The slope surface 3 has an inclination of 1:1,5. On the surface 3 of the slope there is a support band arrangement 5, which is embedded in a slope cover 6, which may have a depth of about 20 centimeters and consists of a soil suitable for the growth of plants. The soil is dumped on the surface 3 of the slope 3 after having established the support band arrangement 5 and is spread out and leveled. The slope cover 6 covering the surface 3 of the slope with the inclusion of the support band arrangement 5 is planted with vegetation in order to secure the slope and safeguard it against erosion when the plants are large enough. The support band arrangement 5 functions, at least until this time to secure the slope cover 6 against slippage on the slope surface 3, more especially when there is prolonged and/or heavy rainfall.

Figure 2:
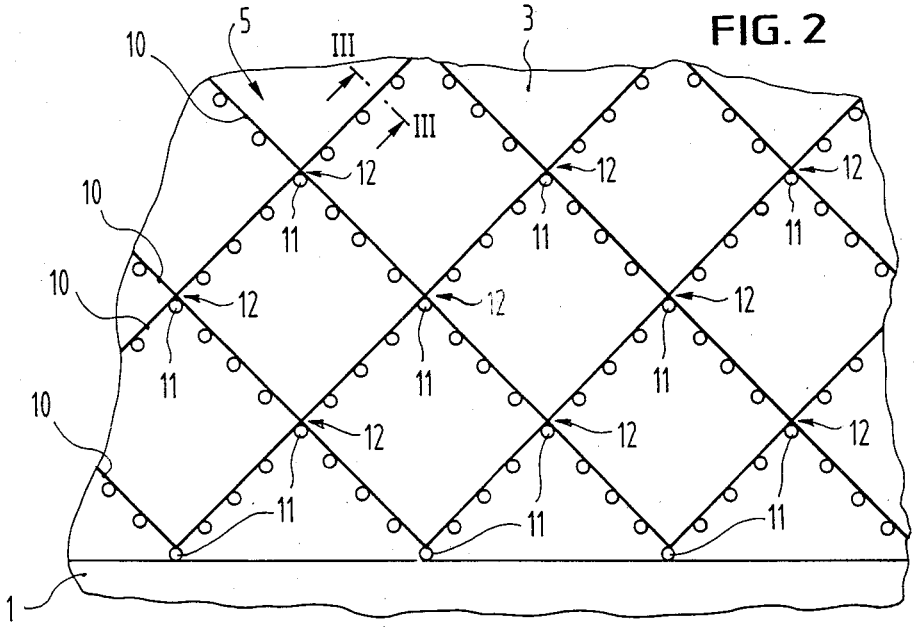
FIG. 2 is a view looking in the direction of the arrow II in FIG. 1.

As shown in FIG. 2 the support band arrangement 5 consists of a number of support bands 10 and pegs 11, which are driven generally vertically into the slope surface 3 and to which the support bands 10 are fixed. The support bands 10 form a network on the slope surface 3 with square openings, which may have a side length of about 3 meters and whose two diagonals are parallel to the foot of the slope and to the slope line, respectively. At each corner of a opening there is a peg 11. Between the two corner pegs 11 of each side of an opening there are three further pegs 11 with an even spacing so that the pegs 11 are therefore arranged with distances of about 75 centimeters between them.

In each case the support bands 10 run in a zig-zag manner between the two ends of the slope, not shown, that is to say between the left and the right side of FIG. 2; they extend on edge along the surface 3 of the slope and adjacent support bands 10 contact each other at adjacent bends 12 so that it is possible for water to pass from the respective upper support band 10 into the respective lower support band 10 and the network forms a coherent system for draining off water to the slope cover 6 to the foot thereof. The support bands 10, which each have a breadth of about 20 centimeters in accordance with the said height of the cover 6 of the slope, rest on the pegs 11 on the side thereof facing the top 4 of the slope so that they are reliably supported and able to take up the loading effect of the cover 6 of the slope and this load does not have to be transmitted via the attachment of the support bands 10 to the pegs 11 to the latter.

Figure 3:
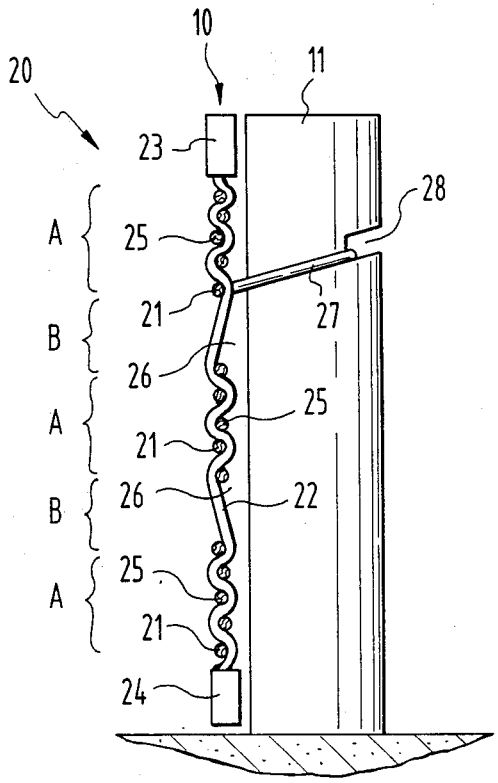
FIG. 3 is a section taken on the line III-III of FIG. 2 on a larger scale.

As indicated in FIG. 1 and more specially emphasised in FIG. 3 the support bands 10 each consist of a fabric 20 with warp threads 21 and filler threads 22, which are plain woven and provide for a high degree of strength and stability and which is provided with leno woven selvedges 23 and 24, that bring an even greater strength and stability and make certain that the warp threads 21 do not become frayed. Additionally the fabric 20 is reinforced by inlays 25, that are more especially made of steel wire or rattan cane.

As will be seen from FIG. 3 the warp threads 21 of the band-like fabric 20 with a breadth of about 20 centimeters are placed in groups A, which extend parallel to each other in the length direction of the band-like fabric 20 so that in the same there are correspondingly extending rows B of large openings 26.

For securing the support bands 10 consisting of the fabric 20 on the pegs 11 the fabric 20 is provided with loops 27, which are each formed by a warp thread 21 and are fixed in an obliquely downwardly sloping transverse groove 28 of a peg 11 on the side thereof turned away from the respective support band, as will be seen from FIG. 3.

The warp threads 21 and the filler threads 22 of the fabric 20 consist of yarn, which has been produced from a fiber material of plant origin. Such a fiber material of plant origin may furthermore be needled onto the fabric 20 in order to form a sort of pile cover, this being specially beneficial as regards increasing the capacity to take up and store water.

The fiber material may more especially be hard or bast vegetable fibers, sweet grass or sour grass fibers, sea grass fibers, rush fibers or a mixture thereof, more especially coconut fibers, since yarns produced therefrom are characterized by a high strength and highly fibrous properties. In place thereof or in conjunction therewith it is possible also to use, agave fibers, more especially sisal, kantala or henequen or, banana fibers, more especially manila or New Zealand fibers, or hemp, jut, ramie, sunn, kenaf, urena, rosetta, aloe, cereal straw, reed, esparto grass fibers or a mixture thereof as a fiber material.

The thread density or pick count of the fabric 20 is selected in accordance with the grain size distribution of the material of the slope cover in order on the one hand to ensure satisfactory filling of the granular slope cover material in the openings of the net of the arrangement of support bands and to ensure the best possible conditions for root growth of the vegetation planted on the slope cover 6 while on the other hand ensuring the the slope cover material does not flow through the fabric 20, if the slope cover 6 takes up a comparatively large amount of water and has a relatively low viscosity.

The support bands 10 may be incorporated into the slope cover 6 without any undesired effects on the environment and may remain therein in order to rot in the course of time. While having a high strength they possess a very even and constant permeability for air and water and a very high capacity for absorbing and storing air and water and may be simply and rapidly mounted on the slope 2, using the pegs 11, which are preferably made of wood. In this respect there is a further useful effect inasfar as only a relatively small number of pegs 11 have to be driven in with a relatively large spacing between them. It is just as simple and quick to repair the support band arrangement 5 after damage to the support bands 10. Since the support bands 10 rot in the course of time the support band arrangement 5 will not be in the way of any later removal, modification and renewal operations on the cover 6 of the slope and the slope 2 itself:

The fabric 20 as shown and described and the support band arrangement 5 as shown and described may undergo many different forms of modification. As an example of this, the fabric 20 does not have to have a needled pile of fiber material of plant origin and in place of the plan weave it may have a different one, as for example a twill one. The leno woven selvedges 23 and 24 and furthermore the reinforcing inlays 25 may be omitted. And it is not in all cases necessary to have an arrangement of the warp threads 21 in groups in the fabric 20. The loops 27 of the fabric 20 for securing the fabric to the pegs 11 furthermore do not have to be formed by the warp threads of the fabric 20 and may even be omitted, if another form of support band attachment is selected, as for example by tacking or the like of the support bands 10 on the pegs 11. The breadth of the fabric 20 is not restricted to one of about 20 centimeters.

Furthermore the support band arrangement may be differently designed and for example the support bands 10 may all be parallel to the foot of the slope or all oblique in relation to the slope line or they may be so placed that a grid or network of square openings is produced on the surface 3 of the slope, the sides of such openings being parallel to the foot of the slope and the slope line, respectively. Furthermore, the net openings may have a form other than square, as for example rectangular or triangular. The pegs 11 do not have to be made of wood and it would be possible for them to be in the form of steel or plastic pegs 11, and the transverse grooves 28 of the pegs may have a different form or may be replaced by different support means for the support bands 10, as for example in the form of hooks.

I claim:

1. A slope cover of granular material secured by an embedded support against slippage along an inclined slope surface, said support comprising:

(a) a plurality of support bands consisting of a fabric having warp and filler threads of coconut fibers;

(b) a plurality of pegs driven into the slope surface and having said support bands fixed thereto to extend on edge along and substantially normally to the slope surface to form a network covering the slope surface; and (c) said support bands being attached to said pegs by lateral loops formed by a warp thread of the fabric and extending around the pegs.

2. The slope cover of claim 1 wherein the support bands have coconut fiber needle thereon.

3. The slope cover of claim 1 wherein the support bands are plain woven.

4. The slope cover of claim 1 wherein the support bands have leno woven selevedges.

5. The slope cover of claim 1 wherein the support bands are reinforced by inlays.

6. The slope cover of claim 5 wherein the inlays are steel wire.

7. The slope cover of claim 5 wherein the inlays are made of rattan cane.

8. The slope cover of claim 1 wherein the support bands have a breadth of about 20 centimeters.

9. The slope cover of claim 1 wherein the warp threads of the support band fabric are arranged in groups extending in spaced parallel relationship.

10. The slope cover of claim 1 wherein the support band fabric has lateral loops at regular intervals along its length for attachment to said pegs extending through said loops.

11. The slope cover of claim 10 wherein each peg is provided with a transverse groove to receive a loop of the fabric.

12. The slope cover of claim 10 wherein each peg is provided with a hook to receive a loop of the fabric.

* * * * *

UNITED STATES PATENT AND TRADEMARK OFFICE

CERTIFICATE OF CORRECTION

PATENT NO. : 4,819,372

DATED : April 11, 1989

INVENTOR(S) : Heinrich Schürholz

It is certified that error appears in the above-identified patent and that said Letters Patent is hereby corrected as shown below:

In column 1, line 49, "Modle" should be -- Model --.
In column 2, line 51, insert -- into -- after "incorporated".
In column 3, line 17, delete "3";
, line 49, delete "to" and insert -- in --;
, line 61, delete "are" and insert -- is --;
, line 62, delete "and" and insert -- to --;
In column 4, line 27, insert -- for example, -- after "also to use,";
, line 28, insert -- fibers -- after "henequen";
, line 30, "jut" should be -- jute --;
, line 68, "plan" should be -- plain --.
In column 6, line 8, "needle" should be -- needled --.

Signed and Sealed this

Twenty-sixth Day of December, 1989

*Attest:*

JEFFREY M. SAMUELS

*Attesting Officer* *Acting Commissioner of Patents and Trademarks*